US005817186A

United States Patent [19]

D'Muhala et al.

[11] Patent Number: 5,817,186

[45] Date of Patent: Oct. 6, 1998

[54] CLEANING COMPOSITION FOR METAL OBJECTS

[75] Inventors: Thomas F. D'Muhala, Raleigh; Thomas C. Zietlow, Apex; J. Michael Strickland, Durham, all of N.C.

[73] Assignee: Corpex Technologies, Inc, Morrisville, N.C.

[21] Appl. No.: 644,177

[22] Filed: May 10, 1996

Related U.S. Application Data

[60] Provisional application No. 60/002,138 Aug. 10, 1995.

[51] Int. Cl.[6] ..... B08B 7/00

[52] U.S. Cl. ..... 134/40

[58] Field of Search ..... 134/40

[56] References Cited

U.S. PATENT DOCUMENTS

| | | | |
|---|---|---|---|
| 4,511,488 | 4/1985 | Matta | 252/162 |
| 4,620,937 | 11/1986 | Dellutri | 252/143 |
| 5,112,516 | 5/1992 | Koetzle | 252/162 |
| 5,132,039 | 7/1992 | Sugita et al. | 252/162 |
| 5,213,624 | 5/1993 | Williams | 134/40 |
| 5,281,354 | 1/1994 | Faber | 252/154 |
| 5,356,482 | 10/1994 | Mehta et al. | 134/22.1 |

*Primary Examiner*—Kriellion S. Morgan

*Attorney, Agent, or Firm*—Myers Bigel Sibley & Sajovec

[57] ABSTRACT

A composition and method for decontaminating a surface with the composition is disclosed. The composition comprises from 30 to 70 percent by weight of a terpene-based component, 1 to 15 percent by weight of an amine, 1 to 20 percent by weight of a surfactant, and 5 to 50 percent by weight of an alpha olefin sulfonate or alkoxy sulfate.

10 Claims, No Drawings

CLEANING COMPOSITION FOR METAL OBJECTS

CROSS-REFERENCE TO RELATED APPLICATIONS

The instant application is related to and claims priority from U.S. Provisional patent application Ser. No. 60/002,138, filed 10 Aug. 1995.

FIELD OF THE INVENTION

The present invention relates to a composition and method for decontaminating a surface using the composition. More particularly, the invention relates to a composition and method for decontaminating a metal surface containing an organic material.

BACKGROUND OF THE INVENTION

Organic materials designed for commercial and industrial use are often transported in equipment having a metal surface. Typical organics include oils, greases, latexes, waxes, paraffins, tars, asphaltenes, and the like, and typical metals which are employed include carbon steel, stainless steel, copper, aluminum, brass, and alloys. Specifically, the organic materials often contaminate the metal surfaces they are contained or transported in such as organic materials transported in rail cars; processing equipment employed in petrochemical plants and refineries; ship tanks; and the like. Typically these objects are cleaned in hot caustic solution to dissolve the organic contaminant. Using such a solution, however, suffers from numerous drawbacks. Caustic is relatively slow to clean a vessel because chemical hydrolysis had to occur. Moreover, the caustic is dangerous to handle for workers since skin contact often results in chemical burns. The caustic can also react with ammonium-based contaminants to release free ammonia which is a hazard and irritant to workers. Caustic solution is not very reusable and must be totally disposed of as a hazardous waste due to contaminants and high pH (>12).

U.S. Pat. No. 5,356,482 to Mehta et al. proposes a process for decontaminating process equipment and vessels. In particular, Mehta et al. proposes utilizing a cleaning agent such as a terpene-based extractant which is vaporized by the use of steam to remove organic contaminants, particularly potentially hazardous contaminants such as benzene. The use of steam, however, is disadvantageous in that it requires additional cost in terms of energy needed to vaporize the water.

It would be desirable to provide a composition and method of decontaminating a surface which utilizes substantially non-hazardous chemicals which are biodegradable, and does not require the use of steam. Moreover, it would be particularly desirable to provide a composition and method for decontaminating a surface such that subsequent to decontamination, the composition may be re-usable.

SUMMARY OF THE INVENTION

In view of the above, it is an object of the present invention to provide a composition and method for decontaminating surfaces wherein the composition employs substantially non-hazardous materials and is biodegradable.

It is a further object of the present invention to provide a composition and method for decontaminating surfaces which may be employed at lower temperatures so as to not require the use of steam.

It is yet another object of the present invention to provide a composition and method for decontaminating surfaces such that the composition may be separated from the contaminant and thus may be readily re-usable.

To these ends and others, the present invention provides a composition suitable for removing organic contaminants. Specifically, the composition comprises from 30 to 70 percent by weight of a terpene-based component, 1 to 15 percent by weight of an amide, 1 to 20 percent by weight of a surfactant, and 5 to 50 percent by weight of an alpha olefin sulfonate or alkoxy sulfate.

The present invention also provides a method of decontaminating a surface. Specifically, the method comprises providing a metal surface having the organic contaminant, and contacting the metal surface with a composition which comprises 30 to 70 percent by weight of a terpene-based component, 1 to 15 percent by weight of an amide, 1 to 20 percent by weight of a surfactant, and 5 to 50 percent by weight of an alpha olefin sulfonate or alkoxy sulfate so as to decontaminate the surface. In a preferred embodiment, the method further comprises separating the composition from the contaminant such that the composition is re-usable.

DETAILED DESCRIPTION OF THE PREFERRED EMBODIMENTS

The present invention will now be described more fully hereinafter. This invention may, however, be embodied in many different forms and should not be construed as limited to the embodiment set forth herein; rather, this embodiment is provided so that this disclosure will be thorough and complete, and will fully convey the scope of the invention to those skilled in the art.

The composition of the present invention rapidly removes organic contaminants from a surface. Moreover, the composition is biodegradable, and has a flash point substantially higher than the RCRA limit (40 CFR 261.21) of greater than 140° F. The organic contaminants which may be removed include for example, oils, greases, waxes, paraffins, tars, asphaltenes, and the like. The contaminant may be removed from any surface upon which such contaminant typically accumulates including metal surfaces such as those employed in rail car and petrochemical processing applications. Specifically, the composition comprises a terpene-based component, an amide, a surfactant, and an alpha olefin sulfonate or alkoxy sulfonate. Water can be added to dilute the composition.

Suitable terpene-based components have the general chemical formula of $C_{10}H_{16}$ and are based on the isoprene unit $C_5H_8$. Preferred terpene compositions of the present invention include d-limonene, alpha-terpineol, beta-terpineol, alpha-pinene, beta-pinene, alcohols of such compositions, or mixtures thereof. Additionally, terpenes with a flash point greater than 140° F. may be employed. A particularly preferred terpene is SCM/Glidco Organics of Jacksonville, Fla., Glidsol-180, Reentry Solvent D® sold by Environmental Solvents of Jacksonville, Fla., Petroferm® D-312 sold by Petroferm Inc. of Fernandina Beach, Fla., and Petroferm® Bioact sold by Petroferm Inc. of Fernandina Beach, Fla.

Preferably, the terpene-based component is employed in an amount ranging from 30 to 70 percent by weight of the composition, and more preferably, from 40 to 60 percent by weight and most preferably, from 50 to 60 percent by weight.

Suitable amides include palm kernel oil diethanolamide and amides of other oils such as coconut oil.

Preferably, the amide is employed in an amount ranging from 1 to 15 percent by weight of the composition, more preferably, from 5 to 15 percent by weight and most preferably, from 8 to 12 percent by weight.

Any suitable surfactant or mixtures of surfactant can be used and can be of the non-ionic, anionic, cationic or amphoteric type, and of natural or synthetic origin. Suitable surfactants for use in the present invention include, but are not limited to, nonylphenol alkanolamide, (nonylphenoxy) polyethylene oxide, sodium salts of petroleum sulfonic acid, sorbitan sesquioleate, nonylphenol ethoxylate (3–12 moles of ethylene oxide), alcohol ethoxysulfate, polyoxyethylene-polyoxypropylene block copolymer, octylphenoxypolyethoxyethyanol (3–12 moles ethylene oxide), octylphenol ethoxylate (3–12 moles ethylene oxide), and mixtures thereof. Preferred surfactants are non-ionic surfactants such as Mazclean EP™ sold by PPG Industries of Gurnee, Ill., along with T-Det N9.5™ and T-Det N4® sold by Harcros Chemicals of Kansas City, Kans.; Steol L-101™ sold by Stepan Co. of Northfield, Ill.; Pluronic L-101™ sold by BASF of Wyandotte, Mich.; and Triton X-100™ and Triton X-114™, both of which are sold by Union Carbide of Danbury, Conn.

Preferably, the surfactant is employed in an amount ranging from 1 to 30 percent by weight of the composition, more preferably, from 10 to 20 percent by weight and most preferably, from 12 to 16 percent by weight.

Suitable alpha olefin sulfonates or alkoxy sulfates include sodium alcohol ethoxy sulfates (e.g., sodium laureth sulfate), tetradecenesulfonic acid, and other alkali metal salts of $C_{10}$ to $C_{20}$ sulfonates or mixtures thereof.

Preferably, the alpha olefin sulfonate or alkoxy sulfate is employed in an amount ranging from 5 to 50 percent by weight of the composition, more preferably, from 10 to 30 percent by weight and most preferably, from 20 to 25 percent by weight.

An inorganic scale removing compound may be employed for removing inorganic scale from a surface. For the purposes of the invention, the term "inorganic scale" may be construed to include, but is not limited to, oxides, sulfates, and phosphates of metals such as iron, calcium, and barium. Any appropriate inorganic scale removing compound may be used including, but not limited to, polycarboxylic acids, aminopolycarboxylic acids, along with salts and mixtures thereof. Aqueous blends of any of the above components may be employed. Suitable polycarboxylic acids include citric acid, oxalic acid, and mixtures thereof. Suitable aminopolycarboxylic acids include ethylenediaminetetraacetic acid, diethylenetriaminepentaacetic acid, triethylenetetraaminehexaacetic acid, N-2-hydroxyethylethylenediaminetriacetic acid, propylene-1,2-diaminetetraacetic acid, propylene-1,2-diaminetetraacetic acid, nitrilotriacetic acid, the ammonium, alkyl ammonium, and alkali metal salts of the acids, and mixtures thereof.

A hydrazide may be employed as an inorganic scale removing compound, alone or in mixture with any of the above compounds. For the purposes of the invention, a hydrazide may include any suitable hydrazide compound, an alkali metal or ammonium salt of the hydrazide compound, or mixtures thereof. Hydrazides which may be employed are numerous and include those described, for example, in U.S. Pat. Nos. 4,609,757 and 4,726,907 to D'Muhala et al.; and U.S. Pat. No. 4,708,805 to D'Muhala, the disclosures of which are incorporated by reference in their entirety. Typically, the hydrazides are derived from known reactions which typically involve amino polycarboxylic acids such as, for example, an amino polyacetic acid. Specifically, tetrahydrazide formed from EDTA may be employed. Other hydrazides which may be used include carboxyhydrazides, i.e. polycarbazic acids. Exemplary polycarbazic acids are of the general formula:

$$(R)_2—N—[CH_2CH_2N(R)]_m—R$$

wherein R is the group $CH_2$—CO—NH—NH—COOH and m is 0 or an integer from 1 to 4. Preferably, m is 0 or 1. Another suitable polycarbazic acid includes that described by the general formula:

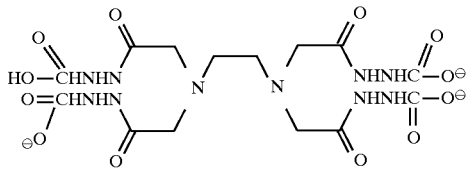

The inorganic scale removing compound may be employed in any appropriate amount. Preferably, the composition includes from 0.1 to 50 weight percent of the inorganic scale removing compound, and more preferably from 3 to 10 weight percent.

Various dispersants may be used in the invention. A suitable dispersant for organic contaminants is Tamol SN™, a sodium salt of naphthalenesulfonic acid, available from Rohm & Haas, Philadelphia, Pa. A suitable dispersant for inorganic scale is sodium lignosulfonate. Preferably, the composition may comprise between 0 to 1 weight percent of dispersant.

Various foamers may be used in conjunction with the inorganic scale removing compound. The foamers are designed to increase the contact time on the surface, especially a vertical surface. Preferably, polyethylene glycol is employed as the foamer. A commercially preferred foamer composition includes 33 weight percent of Polyglycol P 425™ sold by Dow Chemical Company of Midland, Mich. and 67 weight percent of Tegobetaine S™ sold by Goldschmidt Chemical Corp. Preferably, the composition comprises between about 0 to about 1 weight percent of foamer.

A gelling agent may be employed with the inorganic scale removing compound. The gelling agent is designed to increase the contact time with the surface, especially a vertical surface. Preferably, hydroxypropyl methylcellulose is utilized. A commercially preferred gelling agent is Methocel 311™ sold by Dow Chemical Corp. of Midland, Mich. The composition preferably comprises between 0 to 1 weight percent of gelling agent.

The present invention is also directed to a method for decontaminating a surface. The method includes providing a surface having an organic contaminant, and contacting the surface with the composition so as to decontaminate the surface. In one embodiment, the method includes the step of separating the composition from the contaminant such that the composition is re-usable. The separation step is preferably carried out by heating the composition.

Any conventional technique can be employed to contact the composition to the metal object. Contacting of the object may be accomplished by spraying, immersing, showering, etc. After contacting, the object is preferably subjected to a water rinse.

The method of the invention also may include applying an inorganic scale removing compound to the surface so as to remove inorganic scale that may be present on the surface. The inorganic scale removing compound may be applied by any suitable means known to the skilled artisan. For example, such compounds could be applied to the surface in a dip tank with or without agitation; sprayed onto the surface at low to high pressures such as 30 to 250 psi; foamed onto a surface using a foaming additive; and gelled onto the surface using an appropriate gelling agent.

In a preferred embodiment, the method further comprises separating the composition from the contaminant such that the composition may be re-used. Specifically, the emulsion containing the contaminant has the property that it will de-emulsify over time. As a result, the separation of the contaminant from the bulk composition may be effected. This reduces the hazardous waste for disposal and allows the composition of the invention to be re-usable.

Advantageously, the composition of the invention is biodegradable and has a flash point >140° F., both neat and as an aqueous emulsion, and is therefore not a RCRA hazardous waste by ignitability.

The following examples are provided to illustrate the present invention, and should not be construed as limiting thereof.

EXAMPLE 1

Sucker rods in oil wells develop coatings of heavy hydrocarbons and paraffins during use. These heavy coatings impair the operation of the oil well and have to be removed periodically. The method in use industrially today is immersion of contaminated sucker rods in hot kerosene, which presents health and safety concerns as well as a substantial fire hazard.

A mixture of terpene-based component (55% by volume), palm kernel oil diethanolamide (9%), nonyl phenol ethoxylate [MW 638] (6%), nonyl phenol ethoxylate [MW 396] (9%), surfactant (15%) and a solution of 35% sodium laureth sulfate (21%) was diluted with 9 parts water. The flash point of the resulting suspension was >140° F. Sucker rods were immersed in the dilute invention solution and in a kerosene solution. Each solution was held between 80° C. and 90° C. for the example.

| | Concentration | Agitation | Time to Clean | Post-treatment Separation |
|---|---|---|---|---|
| Kerosene | 100% | No | 10 minutes | No |
| Invention | 10% | No | 10 minutes | Yes |
| Invention | 10% | Yes | 5 minutes | Yes |

At low concentrations in water, the invention works as well as the kerosene, with less risk of fire due to higher flash point. After cooling, a layer of contaminant removed during the cleaning separated to the top of the invention emulsion. This layer could be removed and the remaining invention emulsion re-used. No separation occurred in the kerosene solution, so the total volume would have to be disposed of as hazardous waste. A test experiment showed that with agitation, such as air sparging, the cleaning time can be reduced in the invention by half. The kerosene solution cannot be air-sparged due to safety considerations.

EXAMPLE 2

Wire line dressing is a grease which is used in the oil and gas drilling industry. Currently in the field, a chlorinated hydrocarbon solvent, 1,1,1 trichloroethane, is being used to clean the grease off drill parts. This solvent will no longer be in use after Jan. 1, 1996 due to its health risks.

The identical formulation as in Example 1 was used at 10% concentration to remove wire line dressing from coupons. A comparative example of d-limonene at 10% concentration was also used. The invention (at 70° C.) emulsified the wire line dressing and removed it from the coupon. After cooling to room temperature a contaminant layer on top of the emulsion formed, allowing for removal of the contaminant layer and reuse of the emulsifying solution. This minimizes the disposable waste to the industry. The comparative example did not form a stable emulsion at the cleaning temperature and, after cooling to room temperature, completely separated into aqueous phase and a d-limonene phase (with contaminant). No separation of d-limonene and contaminant occurred, therefore no reuse of cleaning chemistry is possible, and the waste volume is increased because of the contaminated d-limonene is also waste.

EXAMPLE 3

A filter sample typical of that employed in the petroleum refinery business was pre-treated with a 10 weight percent aqueous solution encompassing the composition of the invention for 2 hours, and was subsequently treated with a known conventional solvent. Another similar filter sample was treated only with a conventional known solvent. Both samples were contaminated with both organics and with radioactive radium sulfate scale. The sample treated only with the solvent removed 25 percent of the radioactivity. The sample pre-treated with the solution of the invention was found to remove 95 percent of the radioactivity. Advantageously, the unregulated disposal of the pretreated filter could be carried out.

EXAMPLE 4

The removal of asphalt from carbon steel coupons using various compositions of the invention was investigated. A 50 mil layer of asphalt was coated on carbon steel coupons. A 500 ml solution of the invention (10% by volume in water) was prepared and heated to 65° C. For comparison, 500 ml 10% solutions of Serv-Tech™ A and Serv-Tech™ B, both of which are sold by Serv-Tech, Inc. of Houston, Tex.; and U-657 Zymeflow™ sold by United Technologies of St. Charles, Ill. were prepared and heated to 65° C. The compositions of the Serv-Tech® solutions A and B are described in U.S. Pat. No. 5,356,482 to Mehta et al. and are presented in the table below.

| Serv-Tech A: | Weight Percent |
|---|---|
| D-Limonene | 57% |
| Plutonic 10R-5 | 9% |
| Monamulse 653-C | 17% |
| Butyl Cellusolve | 3% |
| Macon 10 | 5% |
| Water | 9% |
| **Serv-Tech B:** | **Weight Percent** |
| D-Limonene | 57% |
| Pluronic 10R-5 | 9% |
| Monamulse 653-C | 17% |
| Igepal CO 530 | 8% |
| Water | 9% |

The coupons were placed in the solutions and agitated using a 1" stir bar at 500 rpm. The condition of the coupon and the solution was noted after every 30 minutes. The following results were obtained:

Time: 1.5 hours

| 10% Solution | % Asphalt Removed | Comments |
|---|---|---|
| Invention | 75 | solution is dark brown |
| Serv-Tech ™ A | 50 | solution is brown |
| Serv-Tech ™ B | 55 | solution is dark brown |

As is evident, the emulsion of the present invention exhibited a faster rate of contaminant removal relative to the Serv-Tech™ solutions.

That which is claimed:

1. A method of decontaminating a surface comprising:

providing a surface having the organic contaminant;

contacting the surface with a composition comprising 30 to 70 percent by weight of a terpene-based component, 1 to 15 percent by weight of an amine, 1 to 20 percent by weight of a surfactant, and 5 to 50 percent by weight of an alpha olefin sulfonate or alkoxy sulfate so as to decontaminate the surface.

2. The method according to claim 1 wherein the terpene-based component is selected from the group consisting of d-limonene, alpha-terpineol, beta-terpineol, alpha-pinene, beta-pinene, 1-methyl-4-isopropylene-1-cyclohexane, and mixtures thereof.

3. The method according to claim 1 wherein the amine is selected from the group consisting of palm kernel oil diethanolamide, coconut oil amide, and mixtures thereof.

4. The composition according to claim 1 wherein the alpha olefin sulfonate or alkoxy sulfate is selected from the group consisting of sodium laureth sulfate, tetradecene-sulfonic acid, alkali metal salts of $C_{10}$ to $C_{20}$ sulfonates, and mixtures thereof.

5. The method according to claim 1 wherein the surfactant is selected from the group consisting of nonylphenol alkanolamide, (nonylphenoxy)polyethylene oxide, sodium salts of petroleum sulfonic acid, sorbitan sesquioleate, nonylphenol ethoxylate, alcohol ethoxysulfate, polyoxyethylene-polyoxypropylene block copolymer, octylphenoxypolyethoxyethanol, octylphenol ethoxylate, and mixtures thereof.

6. The method according to claim 1 further comprising water.

7. The method according to claim 1 wherein the surface contains inorganic scale and further comprising applying an inorganic scale removing compound to the surface so as to remove inorganic scale from the surface.

8. The method according to claim 7 wherein the inorganic scale removing compound is selected from the group consisting of ethylenediaminetetraacetic acid, citric acid, oxalic acid, a hydrazide, and mixtures thereof.

9. The method according to claim 1 further comprising separating the composition from the contaminant such that the composition is re-usable.

10. The method according to claim 9 wherein said step of separating the composition from the contaminant is carried out by heating the composition.

* * * * *